US009337542B2

(12) United States Patent
Coburn et al.

(10) Patent No.: US 9,337,542 B2
(45) Date of Patent: May 10, 2016

(54) MODULAR GRIDDED TAPERED SLOT ANTENNA

(71) Applicants: William O. Coburn, Dumfries, VA (US); Amir I. Zaghloul, Bethesda, MD (US)

(72) Inventors: William O. Coburn, Dumfries, VA (US); Amir I. Zaghloul, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 472 days.

(21) Appl. No.: 13/686,962

(22) Filed: Nov. 28, 2012

(65) Prior Publication Data

US 2013/0241787 A1 Sep. 19, 2013

Related U.S. Application Data

(60) Provisional application No. 61/610,499, filed on Mar. 14, 2012.

(51) Int. Cl.

| | |
|---|---|
| ***H01Q 9/16*** | (2006.01) |
| ***H01Q 13/10*** | (2006.01) |
| ***H01Q 13/08*** | (2006.01) |

(52) U.S. Cl.
CPC ..... *H01Q 13/106* (2013.01); *H01Q 13/085* (2013.01)

(58) Field of Classification Search
CPC ... H01Q 13/0885; H01Q 13/106; H01Q 1/38; H01Q 21/064
See application file for complete search history.

(56) References Cited

U.S. PATENT DOCUMENTS

| | | | | |
|---|---|---|---|---|
| 3,599,217 | A * | 8/1971 | Grant | H01Q 11/10 343/792.5 |
| 6,839,038 | B2 * | 1/2005 | Weinstein | 343/795 |
| 7,205,953 | B2 * | 4/2007 | Knadle et al. | 343/792.5 |
| 8,558,748 | B2 * | 10/2013 | Chen et al. | 343/815 |
| 2005/0285809 | A1 * | 12/2005 | Louzir et al. | 343/770 |
| 2006/0061513 | A1 * | 3/2006 | Sato | 343/767 |
| 2012/0293387 | A1 * | 11/2012 | Ohno | 343/818 |

* cited by examiner

*Primary Examiner* — Trinh Dinh
(74) *Attorney, Agent, or Firm* — Alan I. Kalb

(57) ABSTRACT

A planar antenna comprising: a substrate, a resonant element generating an electromagnetic wave, a plurality of parallel, spaced apart conductive strips on the substrate, wherein conductive strips form collinear rows of at least two strips that are physically separated by a slot to guide the electromagnetic wave in a specific direction.

5 Claims, 7 Drawing Sheets

MODULAR GRIDDED TAPERED SLOT ANTENNA

CROSS REFERENCE TO RELATED APPLICATIONS

This application claims benefit of U.S. provisional patent application Ser. No. 61/610,499, filed Mar. 14, 2012, which is herein incorporated by reference.

GOVERNMENT INTEREST

Governmental Interest—The invention described herein may be manufactured, used and licensed by or for the U.S. Government

FIELD OF INVENTION

Embodiments of the present invention generally relate to communication systems and, more particularly, to tapered slot antennas.

BACKGROUND OF THE INVENTION

Various structures have been developed in the field of antenna design to maximize signal strength and fidelity while minimizing cost and size. One antenna structure is the tapered slot antenna (TSA). Much of antenna design literature also use "tapered-notch," "flared-slot," and "tapered-slot" interchangeably with TSAs. TSAs consist of a tapered slot etched into a thin metal film, either with or without a dielectric substrate on one side of the film.

TSAs are travelling wave type antennas that offer simple, lightweight topology capable of radiating over a wide bandwidth with superior radiation performance and impedance matching compared to other slot antennas. TSAs are frequency independent, meaning the antenna pattern and impedance remain constant over a relatively wide frequency bandwidth. A TSA can be designed with a variety of taper profiles to optimize antenna pattern, bandwidth and/or gain.

One profile has a gradual curve shape with an exponential taper that enables multiple operating frequencies and high gain, is known as an exponential TSA. The exponential TSA is able to operate over wide bandwidths and produce a symmetrical end-fire beam with appreciable gain and low sidelobes. The size of the guiding slot is constant in wavelength and TSAs have a broad operating frequency range, with constant beam width over this range.

FIG. 1 illustrates the basic construction of an Exponentially Tapered Slot Antenna (ETSA) 140. The ETSA 140 comprises a substrate 150, an upper solid copper portion 130, a slot 145, a lower solid copper portion 135, and a radiating element 120. The electrical feed line (not shown) provides an input signal to the radiating element 120. Following the radiating element 120, is a slot 145 with a particular input slot width 115, a slot width at the radiating area 110, and the output slot width 100. The ETSA antenna 140 has two width areas (shown as from 120 to 110, and 110 to 100). The first area (from 120 to 110) being a propagating area to propagate a signal from feed line 120 and the second area 105 defined approximately from slot 145 with width 110 to the output slot 100, guides a travelling wave directionally away from the feed line 120. The ETSA 140 exemplifies the typical TSA comprising three portions: a solid copper upper portion 130, a solid copper lower portion 135, and an input microstrip feed line 120.

The conventional ETSA faces challenges involving beam shaping and beam switching, especially in the context of antenna arrays. Specifically, the topology for wideband application is limited by the technique used to couple the feed line signal to the input slot. The feed line supplying the signal is typically soldered or otherwise electrically connected in a fashion that requires another layer and/or is otherwise not easily removable. Furthermore, to create an array of ETSAs, requires multiple additional layers in the same plane or on different planes such as to require a large amount of additional materials.

The fabrication of conventional TSA antennas carries a high cost of materials for forming a solid curved conductive structure used to radiate the beam. The solid conductive metal on the substrate also creates undesirable surface waves with energy detracting from the radiated signal. Furthermore, the conventional TSA loses energy from the radiated signal to the conductive edges or through absorption into the substrate.

Therefore, a need exists for a compact, cost effective, robust antenna adaptable to operate at multiple frequencies.

BRIEF SUMMARY OF THE INVENTION

Embodiments of the present invention comprise a planar antenna comprising: a substrate, a resonant element generating an electromagnetic wave, a plurality of parallel, spaced apart conductive strips on the substrate, wherein the conductive strips form collinear rows of at least two strips that are physically separated by a slot to guide the electromagnetic wave in a specific direction. Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
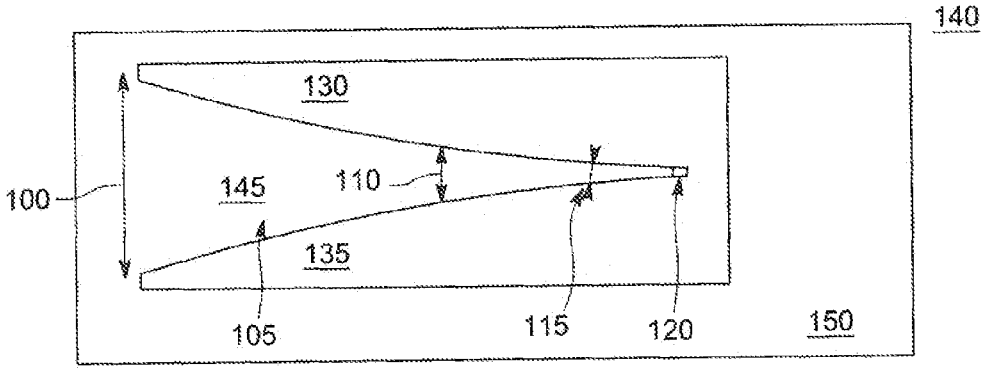
FIG. 1 (RELATED ART)
FIG. 1 is a side view of a conventional Exponentially Tapered Slot Antenna.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION OF THE INVENTION

Figure 2:
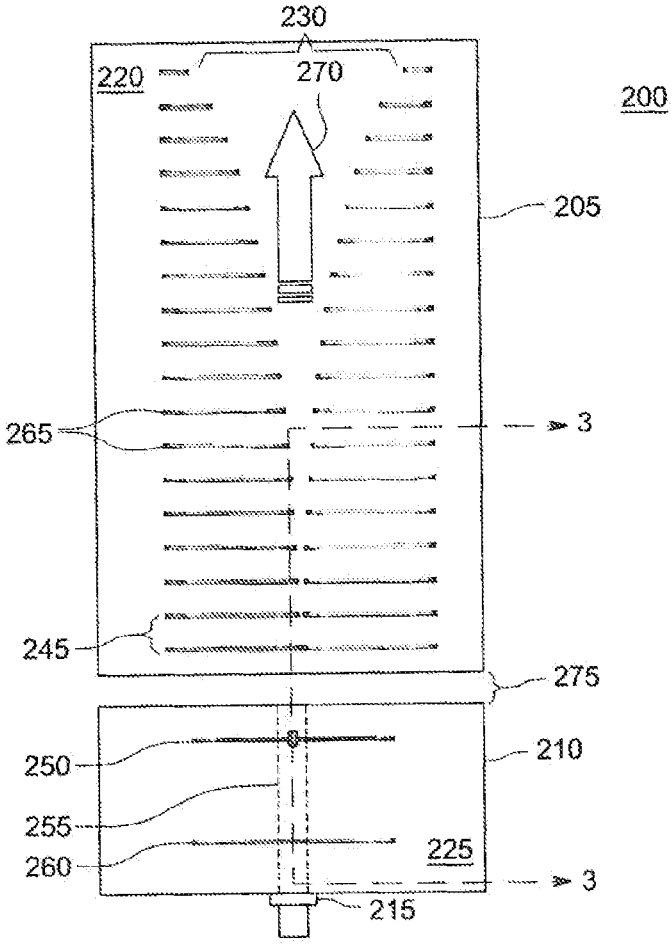
FIG. 2 is an illustration of a gridded tapered slot antenna (GTSA) with a modular resonating element in accordance with one embodiment of the invention.

An embodiment of the present invention comprises a planar gridded exponential tapered slot antenna (GTSA) with a reconfigurable radiating element. The term "gridded" in this disclosure is to mean a one dimensional grid of substantially parallel, separated conductive strips 285. FIG. 2 illustrates a GTSA 200 comprising a director portion 205, and a portion for a modular resonator controller 210. The director portion 205 comprises a slot 230, a plurality of parallel conductive strips (directors) 285 disposed on a substrate 220, a modular resonator controller 210, a resonant element (resonator) 250, a microstrip feed line 255 disposed on a substrate 225, an optional reflector 280, and a connector 215. The optional reflector 280 helps improve forward gain and reduce the backward gain, thus giving a better front to back ratio (F/B). In some embodiments there may be more than one reflector 280 or in other instances none at all.

The GTSA 200 comprises a plurality of conductive strips 285 arranged in collinear rows of at least two strips 285. Each pair of strips 265 defines a gap 245 between the ends of the strips 285. Cumulatively, the strips 265, taken together, are tapered to form an increasingly widened slot 230 driven by a resonant element 250. In one embodiment, the resonator element 250 of the GTSA 200 is a resonant dipole that propagates a signal 270 through the slot 230 using proximity excitation of the nearby conductive strips 265. The dipole 250 of the embodiment thus does not need to be electrically connected to the rest of the structure for operation and forms an adaptable structure when using different resonant sources. While the included examples focus on exponential tapering of the slot 230, other shapes such as linear tapering may be also realized within the scope of invention. In other embodiments, each strip 265 may be formed of strip segments (i.e. a collinear row may have more than two strips). Further embodiments may include substrate materials of predominantly air, with low dielectrics such as foam and cardboard or more conventional microwave substrates such as Duroid, FR4, and G10.

The strips 285 are able to perform the same wave guidance of the signal (arrow 270) as a solid conductor, since the spacing 245 between successive conductive strips 265 is much smaller than a wavelength ($\lambda$) of the propagating signal ($\lambda/10$, for example), the structure mimics a solid conductor. The strips 265 form collinear rows such that the spacing between rows allows the GTSA 200 to cumulatively mimic the electromagnetic wave propagation of a conventional solid conductor TSA. Compared to a solid conductor, the reduction in conductive material using the strips 285 reduces fabrication costs but also minimizes surface waves on the antenna and reduces transmission toss. The spacing 245 of the strips 285 may be uniform or different depending on the desired application requirements.

In some embodiments, the resonant dipole element 250 may share the same substrate 220 as the strips 265 or may be mounted to a modular controller 210. The ability to proximity excite the waveguide conductive strips 285 allows the resonant dipole element 250 to be modular and easily replaceable in some embodiments. In a modular controller 210, the resonant element 250 may be reconfigured such that the dipole element 250 may be moved with respect to the strips 285 through a separable substrate 225 demonstrated by the gap 275. Alternative embodiments may include a dipole element 250 that is replaceable wherein different resonant elements may operate at different resonant frequencies. In one embodiment, each modular controller 210 comprises a substrate 225 separate from the substrate 220 of the conductive strips 285. The modular controller 210 may also include a dipole element that is reconfigurable to radiate at different frequencies. The dipole may be adjusted with respect to the strips 285 for example, through at least one of switches, microelectromechanical systems (MEMS), pneumatic structure, telescopic structure, hydraulic structure, conducting liquids and/or the like.

The substrate 225 of the resonant element 250 further comprises a microstrip feed line 255 to communicate signals to and from a connector 215. Embodiments of the modular controller 210 may or may not include a reflector 260. The connector 215 may be a surface mount sub-miniature type-A (SMA) connector used to transmit and receive signals from various electronics such as receivers, transmitters, transceivers and/or components thereof (not shown).

Figure 3:
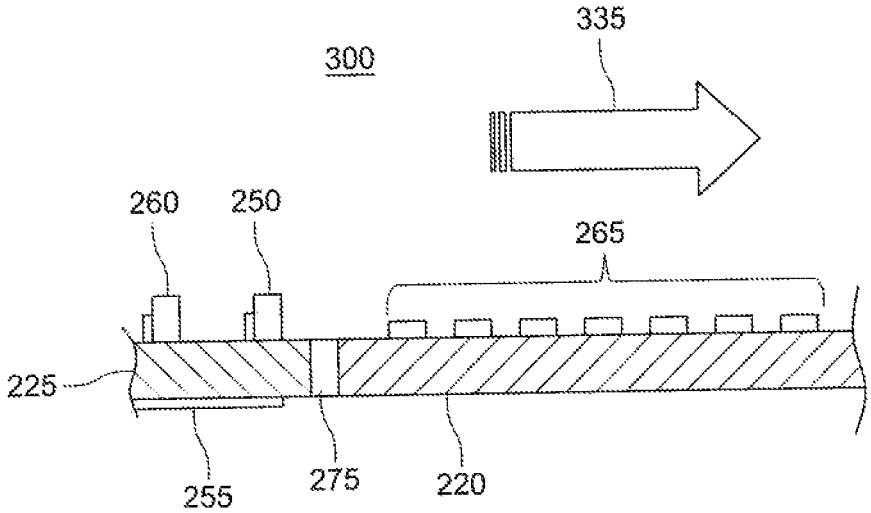
FIG. 3 is a cross-sectional view of a portion of the GTSA of FIG. 2 taken along line 3-3.

FIG. 3 is a cross-sectional view of a portion of the GTSA 200 of FIG. 2 taken along line 3-3. The dipole 250 and reflector 280 are supported on the substrate 225. The substrate 225 is separably/removeablely attached to the substrate 220 upon which the conductive strips 285 are disposed. The conductive strips 285 operate at a wide bandwidth to form a waveguide for electromagnetic waves represented by arrow 335. Because of the wide bandwidth supported by the directors (strips 285) of the GTSA 200, various dipoles 240 and/or dipole structures on substrate 225 may be selectively and/or interchangeably coupled to the substrate 220. Exemplary resonators (i.e. dipole and reflector arrangements) may apply frequencies up to 7 GHz using the conductive strips 285. In one embodiment, the substrate 220 of the wave is located spatially close and not necessarily directly connected to the substrate 225. In further embodiments, the resonator structure may comprise more than one dipole e.g., the reflector 260 may be another dipole resonator operating at a different frequency from the first dipole resonator 250.

Figure 4:
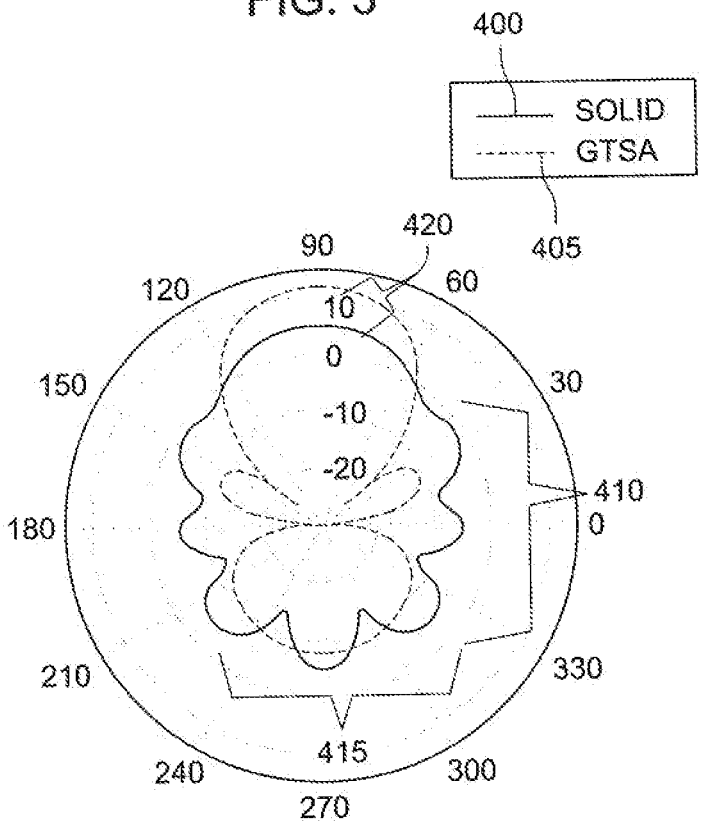
FIG. 4 is an exemplary illustration of the signal pattern of the conventional Tapered Slot Antenna compared to that of a Gridded Tapered Slot Antenna.

FIG. 4 is an exemplary illustration of the radiation pattern of the traditional solid TSA compared to a radiation pattern (graphs 400 and 405) of an embodiment of the GTSA. The patterns of a GTSA operating at 5.5 GHz with less than $\lambda/110$ strip spacing indicate a better impedance match compared to the conventional ISA. The patterns indicate a reduced amplitude 420 and a broader beam width for the conventional ISA. Thus, the GTSA produces better gain than the traditional solid ISA. For the GTSA, the resulting reduced side lobes 410 and back lobes 415 are attributed to the reduced amount of metal present on the substrate. The reduction in conductive material on the substrate results in reduced surface waves and energy loss absorbed into the substrate that now can be guided through the slot.

Figure 5:
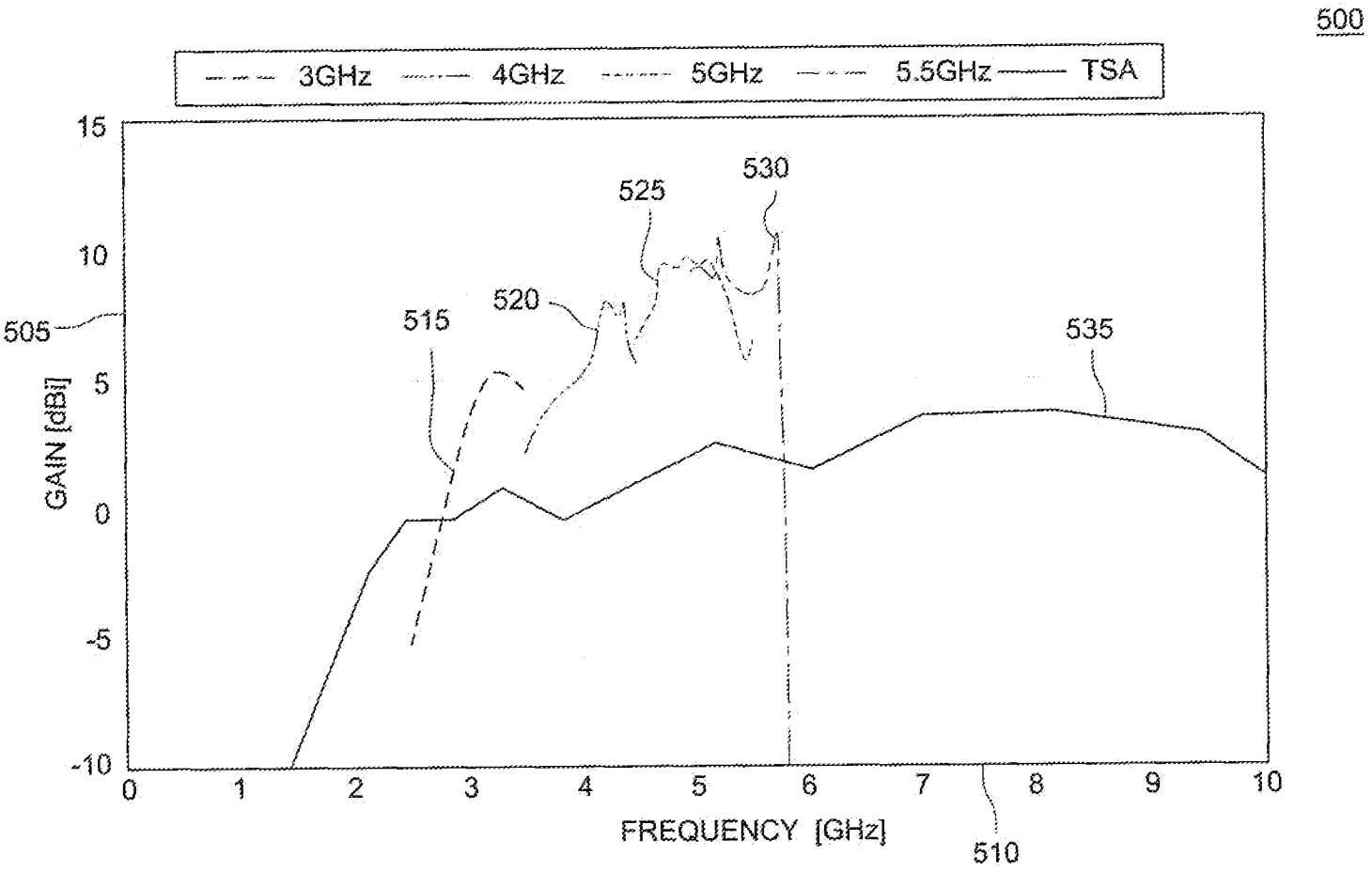
FIG. 5 is a graph comparing gain of an embodiment of the present invention and a conventional Tapered Slot Antenna.

FIG. 5 is an illustration 500 of gain 505 plotted against frequency 510 where the bottom graph 535 is from a traditional solid ISA and graphs 515, 520, 525, and 530 (hereinafter 515-530) are from GTSAs. Each graph 515-530 represents a different GTSA using the same set of directors (strips) and a different resonator optimized for a specific frequency. The graph 535 shows the traditional TSA operating at a much broader frequency band with less gain than any of the four GTSAs graphs 515-530. Each of the GTSA frequency graphs 515-530 is formed using respective resonators at 3 GHz, 4 GHz, 5 GHz, and 5.5 GHz. Each GTSA operates at a much more specific frequency than the traditional TSA. However, FIG. 5 shows the adaptability for the GTSA, where different resonant dipoles are used to yield a higher peak gain at various frequencies than a traditional, solid TSA.

Figure 6:
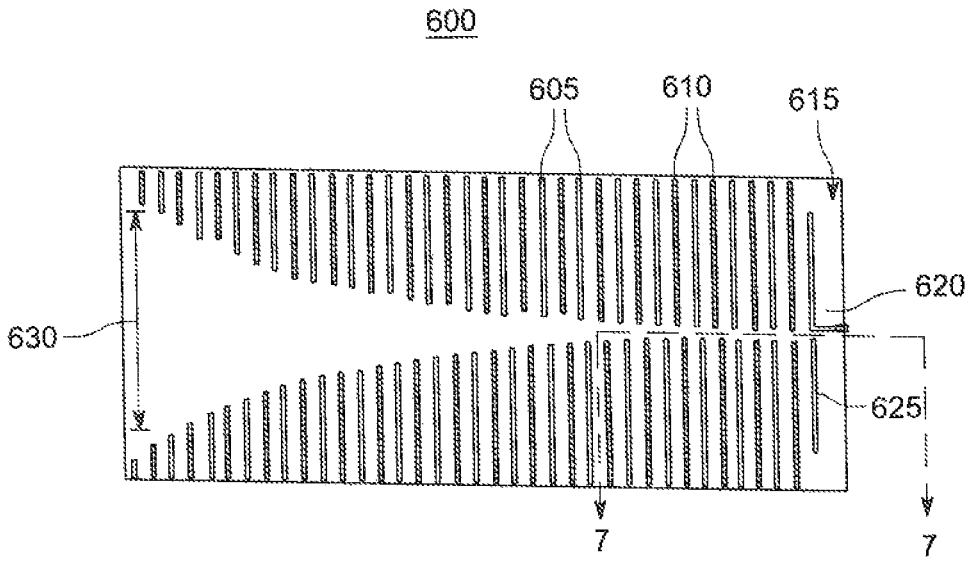
FIG. 6 is an illustration of a staggered strip GTSA disposed on both sides of the substrate in accordance with an embodiment of the invention.

FIG. 6 is an illustration of a staggered strip GTSA disposed on both sides of the substrate in accordance with an embodiment of the invention. In one embodiment of the staggered GTSA 600, the GTSA 600 comprises a first dipole resonator 620, a second dipole resonator 625, a first set of conductive strips (directors) 610, and a second set of conductive strips 605 disposed respectively on each side of a single substrate 615. A single resonator (620 or 625) is located on each side of the substrate 615. The first resonator 620 radiates a first electromagnetic wave to the first set of strips 810 on a first side of the substrate 615. The second resonator 625 radiates a second electromagnetic wave to the second set of strips 605 on a second side of the substrate 615. The first set of conductive strips 610 is staggered on the substrate with respect to the second set of conductive strips 605 disposed on the other side of the substrate 615. Both sets of conductive strips (605 and 610) are capable of broadcasting along the same plane through slot 630 that is formed on both sides of the substrate 615. The strips (605 and 610) are spaced apart by about $\lambda/10$, where $\lambda$ is the wavelength of the desired signal. In one embodiment, the exemplary staggered strips radiate frequencies such as 300 MHz and 400 MHz. For such exemplary resonant frequencies, the overall size of the GTSA 600 is about 35 inches in length, 18.5 inches in width and 3 inches in thickness; however, other dimensions may be used depending on desired operating frequency.

Figure 7:
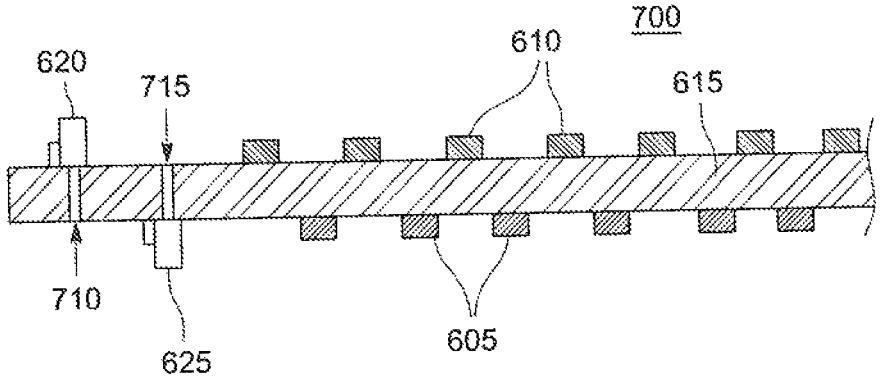
FIG. 7 is a cross-sectional view of a portion the GTSA of FIG. 6 taken along line 7-7.

FIG. 7 is a cross-sectional view of a portion 700 of the GTSA 600 of FIG. 6 taken along line 7-7. FIG. 7 shows the alternating staggered conductive strips 605 and 610 on each side of the substrate 615 with the first resonator 620 receiving signals from a first via 710 in the substrate 660 and the second resonator 625 receiving signals from a second via 715. When stacked, each respective pair of resonator (620 and 625) and conductive strips (610 and 605) is able to transceive signals simultaneously. The operation of respective structures may occur simultaneously, substantially simultaneously, sequentially, or alternating. Other embodiments may include resonators (620 and 625) on a substrate different from the conductive strips (610 and 605) and may employ different connectors besides vias such as SMAs.

Figure 8:
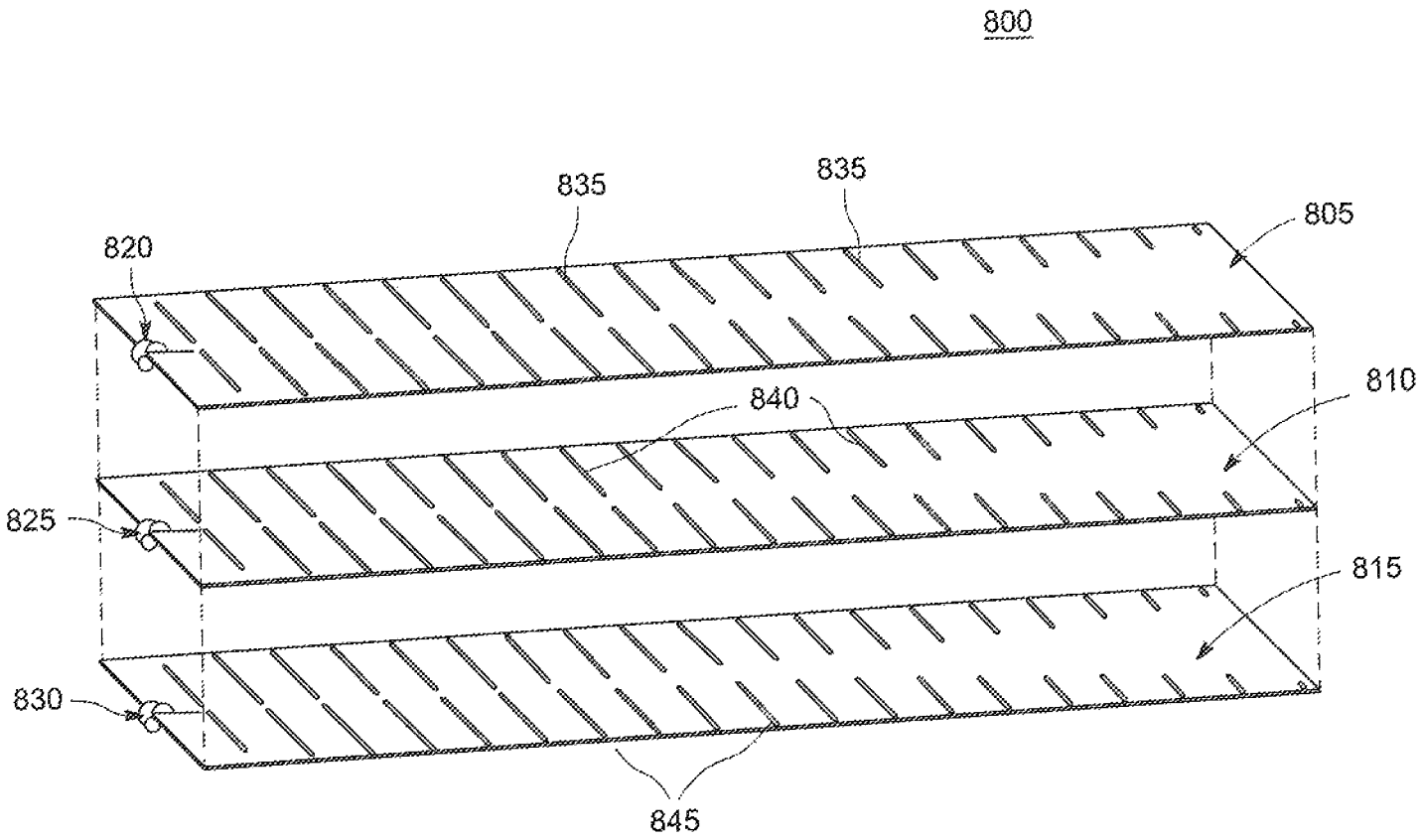
FIG. 8 is an exploded view stacked GTSAs of separate substrates in accordance with an embodiment of the invention.
Figure 9:
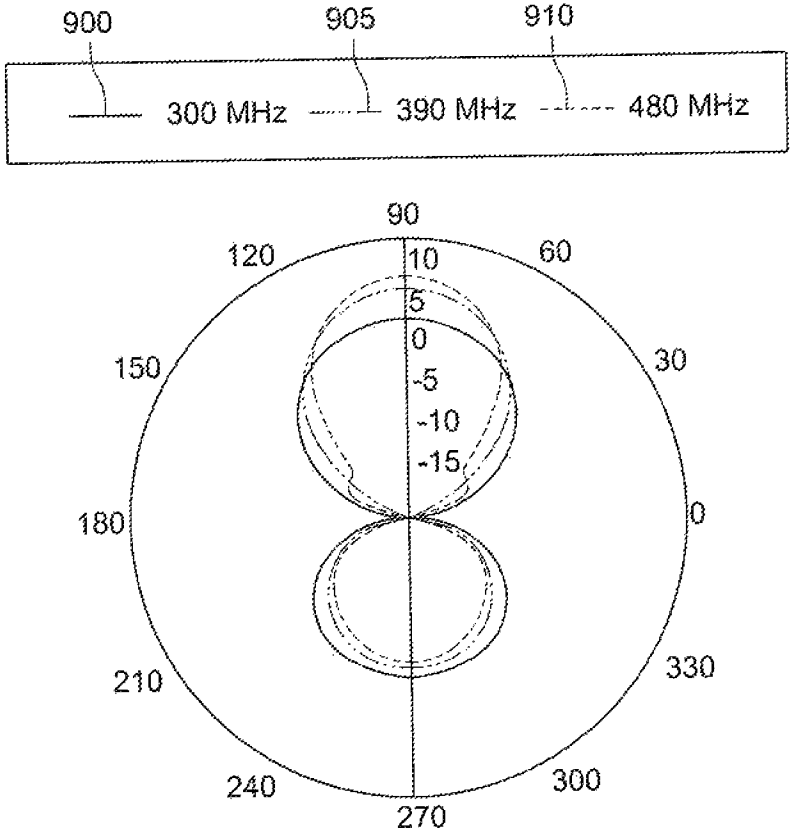
FIG. 9 is an illustration of exemplary radiation patterns from multiple dipole resonators in FIG. 8.

FIG. 8 is an exploded view of stacked GTSAs on separate substrates in accordance with an embodiment of the invention. The stacked GTSA 800 comprises three resonators 820, 825, 830 and three sets of conductive director strips 835, 840, and 845 disposed on three separate stacked substrate layers 805, 810, and 815. In the embodiment of FIG. 8, the three sets of conductive director strips 835, 840, and 845, may be vertically aligned. The stacked layers are separated such that there is no interference between the layers (e.g. 15 mm), the GTSA 800 may operate using multiple communication frequencies. The amount of separation is based on the directional propagation of the standing wave across the strips (835, 840, and 845) of each substrate (805, 810, and 815) such that the propagating wave presented on a first set of director strips 835 does not inadvertently excite the other sets of proximate director strips (840 and 845). Other embodiments may have the strips staggered or transversely offset. Each resonator 820-830, is capable of sending or receiving signals at different frequencies simultaneously or substantially simultaneously. FIG. 9 is an illustration of exemplary radiation patterns from multiple dipole resonators of FIG. 8 operating at 300 MHz 900, 390 MHz 905, and 480 MHz 910. The radiation patterns (900, 905, and 910) depict patterns very similar in shape to those that one would expect to be radiated from a conventional TSA.

Figure 10:
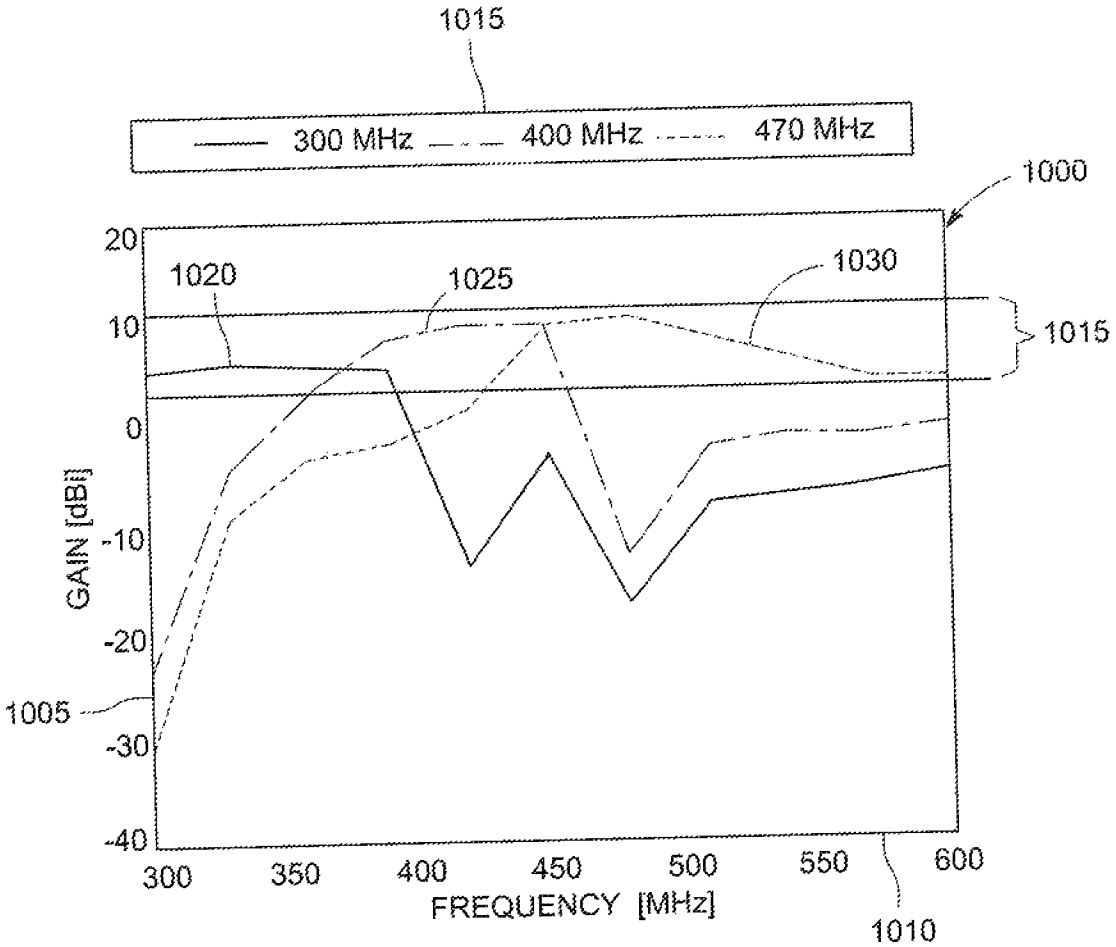
FIG. 10 is a graph of gain versus frequency for the resultant operation of the stacked GTSAs in FIG. 8.

FIG. 10 is a graph 1000 of gain 1005 versus frequency 1010 for the resultant operation of the stacked GTSA in FIG. 8. FIG. 10 shows that while the individual GTSAs (labeled in legend 1015) have a narrow bandwidth, the combination of all three GTSAs (lines 1020, 1025, and 1030) produces an upper envelope 1015 that covers a much larger frequency band than any single GTSA bandwidth. For the most gain, the first GTSA operates from about 300 MHz to 375 MHz, the second GTSA operates from about 375 MHz to 450 MHz, and the third GTSA operates from 450 MHz to 600 MHz. Therefore, when stacked and the resonators operate together, the combined upper envelope provides an overall greater gain and wider band of operation than produced by a conventional TSA.

Some embodiments of the present invention involve mounting the gridded antenna on windows, composite, and plastics of vehicles. The standing wave structure disclosed herein may be manufactured using copper tape, wires, or conductive ink printing. The reduced size of the GTSA beneficially may replace the trailing wire communication antennas on aircraft thereby, reducing the possibility for damage. One of the benefits of the end fire antenna in this embodiment of the invention is providing improved direct point-to-point communications.

While the foregoing is directed to embodiments of the present invention, other and further embodiments of the invention may be devised without departing from the basic scope thereof.

The invention claimed is:

1. A planar antenna comprising:

a substrate;

a resonant element for generating an electromagnetic wave;

a plurality of parallel spaced apart conductive strips on the substrate, wherein conductive strips form collinear rows of at least two strips that are physically separated by a slot to guide the electromagnetic wave in a specific direction the physically separate strips are tapered to increasingly widen said slot such that there is an increasingly widen said slot with each successive row away from the location of the resonant element.

2. A planar antenna comprising:

a substrate;

a reconfigurable dipole resonator for generating an electromagnetic wave;

a plurality of parallel apart conductive strips on the substrate, wherein conductive strips Form collinear rows of at least two strips that are physically separated by a slot to guide the electromagnetic wave in a specific direction the physically separate strips are tapered to increasingly widen said slot such that there is an increasingly widen slot with each successive row away from the location of the resonant element and, wherein the increasingly widened slot results from exponential tapering or linear tapering of the slot.

3. A stacked planar antenna comprising:

a first substrate vertically stacked on a second substrate, a first resonant element and a first plurality of parallel, spaced apart conductive strips disposed on the first substrate, wherein the strips form collinear rows of at least two strips that are physically separated by a first slot to guide the electromagnetic wave in a first direction;

a second resonant element and a second plurality of parallel, spaced apart conductive strips disposed on the second substrate, wherein the strips form collinear rows of at least two strips that are physically separated by a second slot to guide the electromagnetic wave in a second direction, where the rows of the first plurality of conductive strips further comprises the physically separated strips that are tapered to increasingly widen said first slot such that there is a first increasingly widened slot with each successive row away from the location of the first resonant element, and wherein the rows of the second plurality of conductive strips further comprises the physically separate strips that are tapered to increasingly widen said second slot such that there is a second increasingly widened slot with each successive row away from the location of the second resonant element.

4. The stacked planar antenna of claim 3 wherein the dipole resonators are reconfigurable.

5. The stacked planar antenna of claim 3 wherein said increasingly widened slots result from exponential tapering or linear tapering.

* * * * *